United States Patent [19]

Hendrischk et al.

[11] 4,234,261

[45] Nov. 18, 1980

[54] PRINTER

[75] Inventors: Wolfgang Hendrischk, Neu-Ulm; Gerhard Nolte, Ulm; Gerhard Schrader, Rodgau, all of Fed. Rep. of Germany

[73] Assignee: Mannesmann Aktiengesellschaft, Dusseldorf, Fed. Rep. of Germany

[21] Appl. No.: 892,653

[22] Filed: Apr. 3, 1978

[30] Foreign Application Priority Data

Apr. 4, 1977 [DE] Fed. Rep. of Germany ..... 2715428
Apr. 4, 1977 [DE] Fed. Rep. of Germany ..... 2715429

[51] Int. Cl.[3] ..... B41J 11/70; B41J 11/42

[52] U.S. Cl. ..... 400/621; 400/597; 400/608.3; 400/551; 400/578; 400/596; 400/616.2

[58] Field of Search ..... 400/621, 620, 608.3, 400/597, 605, 551, 518.4, 580, 581, 578, 596, 595, 616, 616.2

[56] References Cited

U.S. PATENT DOCUMENTS

| | | | |
|---|---|---|---|
| 2,963,138 | 12/1960 | Motte et al. | 400/600.3 |
| 3,075,626 | 1/1963 | Schultz | 400/621 |
| 4,000,803 | 1/1977 | Warp et al. | 400/551 |
| 4,011,811 | 3/1977 | Kodis | 400/621 |
| 4,043,440 | 8/1977 | Busch | 400/620 |

FOREIGN PATENT DOCUMENTS

| | | | |
|---|---|---|---|
| 2716396 | 10/1978 | Fed. Rep. of Germany | 400/605 |

OTHER PUBLICATIONS

Klein et al., "Electromechanical Variable Index System", IBM Tech. Discl. Bulletin, vol. 17, No. 4, pp. 959-960, 9/74.

*Primary Examiner*—William Pieprz
*Attorney, Agent, or Firm*—Smyth, Pavitt, Siegemund, Jones & Martella

[57] ABSTRACT

The printer is provided for alternative use with long webs or individual, precut forms; it includes two friction roll drives adjacent to the print head and platen, and a sprocket drive upstream, being permanently engaged with a perforated web. The drives operate in synchronism but do not participate in all operations. Printing on the web is carried out after advancing the web by one form length and retracting it during stop and go printing. Switches control access to a bypass, the insert for a single form, and a receiver tray, into which any printed form drops.

21 Claims, 10 Drawing Figures

EXTERNAL
PRINT ELECTR.
MOTOR & DRIVE CONTROL
FROM 24,18 (L)
FROM 24,18
CUT
MOTOR
REV.
CL
B.P.
TO 9
TO 8
TO 53
TO 52
FE1
FE2
VT1

PRINTER

BACKGROUND OF THE INVENTION

The present invention relates to printing of forms such as tickets or the like; and more particularly the invention relates to printers having a print head, e.g. of the needle type, a platen, a sheet, web or strip transport meachnism a cutter for cutting individual forms, e.g. tickets from the sheet or strip and a receiving tray or the like. Moreover, the printer has a controller which controls the operation and cooperation of the aforementioned components.

Printers of the type to which the invention refers usually cooperate with more or less endless webs, sheets or strips onto which tickets or the like have been preprinted as to information common to all tickets, and the particular printer supplements, the printed content by individual data, such as the date, a particular price, etc. The printed ticket is cut and ejected into the tray or the like.

Form printers usually operate also on the basis of a principle taken over from typewriters in which a sheet or bundle of sheets are pulled or pushed through the printing area, particularly on a step by step basis commensurate with line by line printing. In the case of endless sheets, i.e. of a roll of paper, a sheet or form is cut to have that form immediately available. It can readily be seen that the cutter must be disposed upstream from the portion printed on but cutting remains necessarily downstream from the remainder of the web. Thus, the feed device in this case must be disposed upstream from the printed paper as far as the web advance from the roll is concerned, i.e. upstream from the cutter.

Consequently, the web is pushed towards and into the printer rather than being pulled. One does, therefore, not pull the web (or a multi-layer web) through the printer. Pulling from the front is possible only after the cut, leading edge of the web has been moved out of the cutter. On the other hand, it is know from highspeed printers that in the case of line for line printing, and stop and go paper advance in between, pulling is better than pushing, particularly in the case of printing forms with one or more carbon copies.

Other type of ticket printers operate on the basis of precut tickets and particularly pre-printed tickets which are inserted (manually) into the printer, completed as to print content and ejected.

DESCRIPTION OF THE INVENTION

It is an object of the present invention to provide a new form printer which can be operated in either mode without equipment changes, i.e. the printer must be able to accept precut forms such as tickets, or a roll of forms from which the individual ones are cut only when the final printing occurs. Moreover, the entire area of such a form should be available for printing, that is to say zones or areas which cannot be reached by the print head for reasons of transport should not be permitted. Known printers do have that disadvantage.

It is another object of the present invention to provide a new and improved method and equipment for printing forms to be cut from a roll after printing in which the web feed can be pulled rather than pushed during printing.

In accordance with the preferred embodiment of the present invention, it is suggested to provide such a printer having print head and platen and a web advance drive which pulls the web back, line by line during the printing and particularly following a forward advance to place a portion of the web into a printing position, particularly a print starting position. The printer has three paper engaging drives, of which two are disposed respectively in front and in back or upstream and downstream from the print head and platen; the third drive being the one primarily responsible for web advance is e.g. a sprocket drive for perforated webs and is also disposed upstream, further away from the printing zone to remain permanently engaged with a web from which forms are to be cut. This sprocket drive will pull the web through the printer following an advance by a distance equal to a height or length of a form.

These drives are individually drivable and in synchronism with each other, but they are individually disconnectible from a reversable drive. A switch controlled bypass is provided to avoid that a pushed-in precut form be gripped by the sprocket drive that remains engaged with the web. Preferably, a precut ticket is fed to the printer from a direction opposite the web entry, which is the reason the first mentioned two drives must be reversibly controlled. The third one must reverse because this drive must pull the front end of the web out of the immediate vicinity of print space to make room for an inserted precut ticket. However, the position of the web must be restored, as it is advanced by definite lengths such as from cutting position to cutting position that is to say from a position of abutment with a cutter at the plate to a position equal by one form length. Also, the sprocket drive reverses during printing on the web.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figures 2, 3:
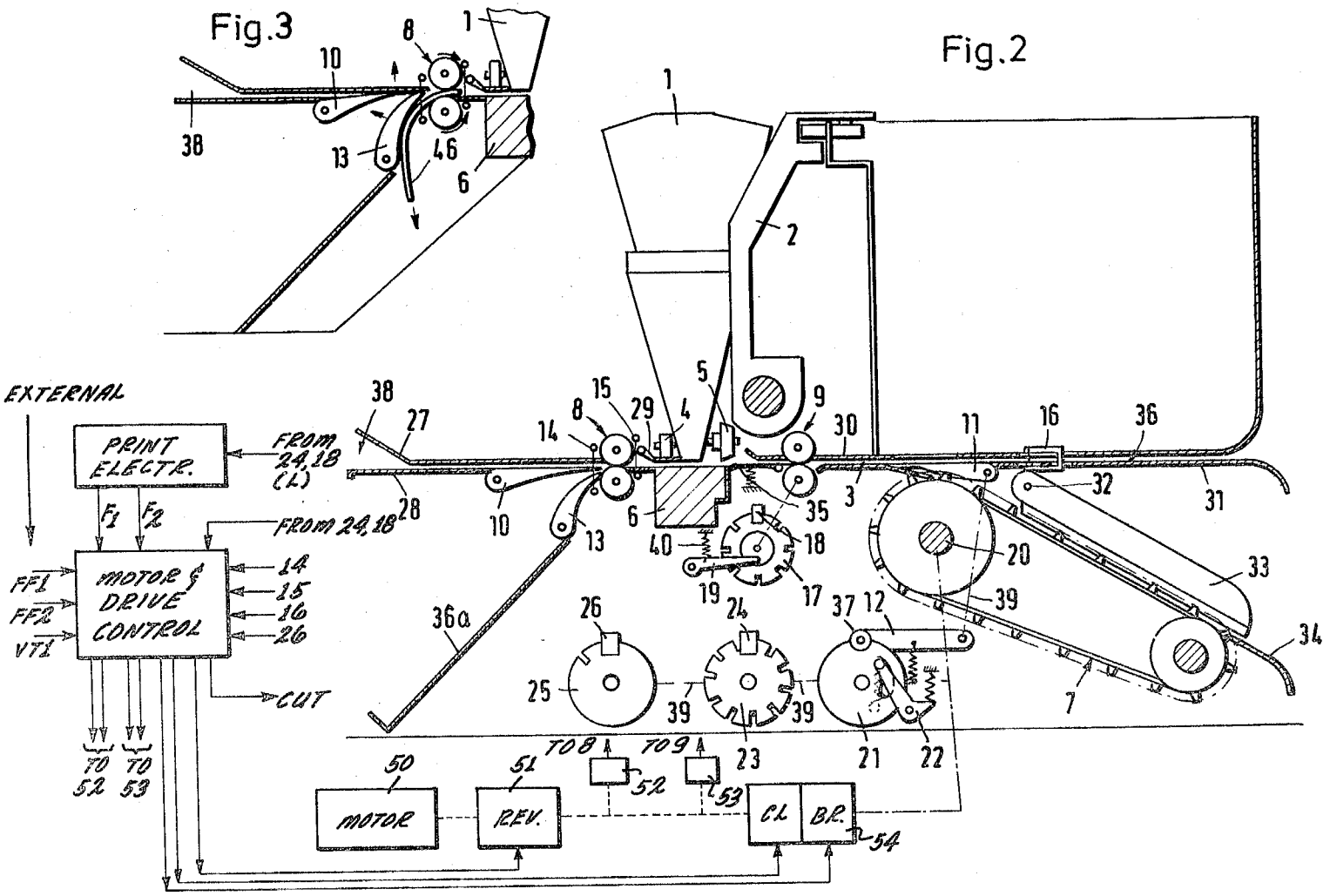
FIG. 2 is a similar but more detailed view of such a printer but showing also some modifications, in accordance with the preferred embodiment.
FIG. 3 illustrates a further detail of FIG. 2.

Proceeding now to the detailed description of the drawings we turn first to FIG. 2, showing a needle type print head 1 mounted on a carriage 2 for movement on a rod and a rail extending parallel to each other and transversely to the plane of the drawing. The carriage 2 is driven in a conventional manner and as is common for matrix printers. The carriage 2 carries also a pressure roller 4 as well as a cutting roll 5; both these rolls cooperate with a platen 6 whose rear edge serves as counter cutting edge for the cutter roll 5, and defines the plane of cutting in the system.

The paper is moved under the print head 1 and between that head and the platen 6 by means of a feed device which moves the paper, web or ticket through a feed track or channel 3. The paper feed track begins at a guide sheet 34 and runs between a flap 33 and a sprocket belt type conveyor 7, a set or pair of drive rolls 9, both being driven and at least one roller is spring biased towards the other one. The track continues between print head and platen 6 followed by another set or pair of drive rolls 8 and ends in a tray 36*a* into which drops a cut ticket.

In the following, we shall call the set or pair 9 the upstream pair of drive rollers and pair 8 will be the downstream pair which designation is understood in relation to the direction of feed from an endless roll or the like as arriving by drive 7; also, that direction is consistent with the outputting of any printed form towards the tray 36*a*. However, it will be understood that the movement of tickets or web will be reversed during certain phases of operation.

Two switches 10 and 11 are arranged along that track 3 to obtain operational modifications thereof. Switch 10 when in position as shown, prevents a ticket from dropping into tray 36*a*. Switch 10 will be in the down position whenever a precut ticket is being pushed into a funnel-shaped receiver opening or entrance 38. This portion can be termed a side entrance of the feed device, it does not participate in the operation of printing on a web as moved by the drive 7, nor does that branch participate in any printing operation once a ticket has been inserted. For this, switch 10 is moved up. Switch 10 when up establishes a path from rollers 8 towards tray 36.

Switch 11 controls a bypass to the right (or upstream) from roller pair 9. This switch 11 is disposed between drives 9 and 7. Upon turning off drive 7, and in a particular position thereof switch 11 connects the bypass track branch 36 to paper track 3; drives 8 and 9 remain always in the track.

The paper is moved in a three-fold manner; going backwards in direction of paper advance, the movement means are comprised of the rolls or roller pair 8, rolls or roller pair 9 and sprocket drive 7. These drives are selectively controllable for synchronous operation as well as for independent operation, including reversing. The drive system includes a common motor 50 operating on its drive output such a reversible clutch transmission 51. The assembly 50,51 could be replaced by a directly reversible motor e.g. a d.c. motor. The common output (forward or reverse) of device 51 is geared or otherwise drivingly linked to three clutch-brake systems 52,53 and 54. The systems 52,53 each have two drive outputs, one each for the two rollers of a pair, whereby 52 cooperates with pair 8 and 53 with pair 9; clutch-brake system 54 cooperates with and drives sprocket drive 7 and appended equipment. Thus, each of the three drives 7,8, and 9 is individually connectable to or disconnectable from a common drive and whenever any two or all three are connected, they run in synchronism with each other. Each of the systems 52 and 53 but not 54 can also be deenergized completely which means that the respective drive does not drive, nor does it hold the web but merely idles, offering little resistance.

The switch 10 is operated conventionally by an electromagnet (not shown). Switch 11 is operated by a spring loaded lever 12 having a roll 37 which engages the periphery of a twin or dual cam disk 21. The track system includes a third switch 13 which is also electromagnetically operated. This switch may eject a ticket in manner bypassing the tray 36*a*, for example in the case of a printing error (see ticket 46 in FIG. 3).

The apparatus includes position signal producing devices such as a light barrier 14 disposed just behind drive rolls 8 and another such light barrier 15 is positioned in front of those rolls. The branch track 36 includes a third light barrier 16, just in front of the switch 11. The signals issued by the photodetectors of the three light barriers are fed to a controller 60 which issues control signals in response thereto, involving primarily the stopping and starting of the motor 50, reversing of the motor and the operation of the several clutch-brake systems.

The lower roll of the roll pair 9 sits on a shaft which carries also a disk 17 having slots which are scanned by a suitable pick-up 18. The elements 17,18 are a clock pulse generator, producing one pulse per line of printing. A stationary but pivotable paw or latch 19 cooperates with a supplemental disk on disk 17 to hold the latter in a particular position upon clockwise rotation thereof, the latch 19 is ineffective for counterclockwise rotation. The disk 17 is disposed in slip friction engagement with a shaft of one of the rolls 9 so that disk 17 is normally driven by the rolls, but part 19 can hold the disk in a particular position when attempting to turn, e.g. clockwise without impeding movement of drive 9.

Reference numeral 20 refers to the drive shaft of the sprocket drive 7 and three disk systems are connected thereto, which are the twin disks 21 mentioned above and two additional clock disks 23 and 25 respectively cooperating with pick-ups 24 and 26. Cam disk 21, when rotated clockwise by the sprocket drive, operates lever 12 to assume a first particular position. Lever 12 is suitably linked (39) to the switch 11 and lever 12 when riding on the periphery of disks 21 pushes switch 11. In an position illustrated in FIGS. 1, 2 and 4 to 6, roller 37 rests in detents in the twin disk and holds switch 11 down. The two disks 21 can move against each other and are placed into a position of mutual orientation by means of arm 22 so that the two arc shaped indents 44,45 (see FIG. 8) are axially aligned, and lever 12 (roll 37) can drop into these aligned indents from the illustrated position in which in effect switch 11 inserts bypass 36 into the track while blocking off the sprocket drive portion of the web track.

The slots in disk 23 are arranged analogously to the slots in disk 17, there is one slot per print line. Disk 25 has but one slot. The system is designed so that upon one revolution of these disks and of shaft 20, the transport device 7 moves the web by exactly one-length of a ticket. This is not essential in principle but convenient and one may interpose suitable gearing. The wheel of the sprocket drive which sits on shaft 20 has a periphery so that the belt advances the web precisely by one form length per revolution. Accordingly, it is essentially that disk 25 makes one revolution for a sheet or web advance by one form length. For this reason, one may term 25,26 also the form clock or ticket frame clock. As far as printing lines is concerned the condition should be maintained that one pulse per line to be printed issues by clock 23,24.

The detectors 18, 24 and 26 provide also inputs for the controller 60 which are pulses indicative of paper movement.

The apparatus and particularly the sheet feed and movement track includes several guiding and control devices, some of them have been mentioned already. The funnel 38 for inserting a preprinted ticket is established by sheets 27 and 28. A spring loaded pressdown sheet 29 is disposed between rolls 8 and print head 1. The right hand edge of sheet 29 is actually engaged by the pressure roll 29 on the print head carriage to be urged against the sheet stock underneath, on and against the platen 6. Reference numeral 30 denotes a cover for the central portion of paper feed track 3.

The bottom sheet and support 31 ends at the switch 11, but can be deemed to continue beyond. The sprocket drive 7 has a cover 33 which can be pivoted about a pin 32. Cover 33 urges the sheet stock against the sprocket protrusions of the belt of drive 7. The protrusions of teeth on the belt engage the sheet stock on a straight portion and for a considerable length so that the load on the perforations is rather low.

Reference numeral 35 refers to a spring loaded rocker which bridges the gap between rolls 9 and platen 6 and thus pertains also to the track. For cutting, roll 5 is lowered, and rocker 35 will yield resiliently in down direction and move back upon retraction of the cutter.

Figure 1:
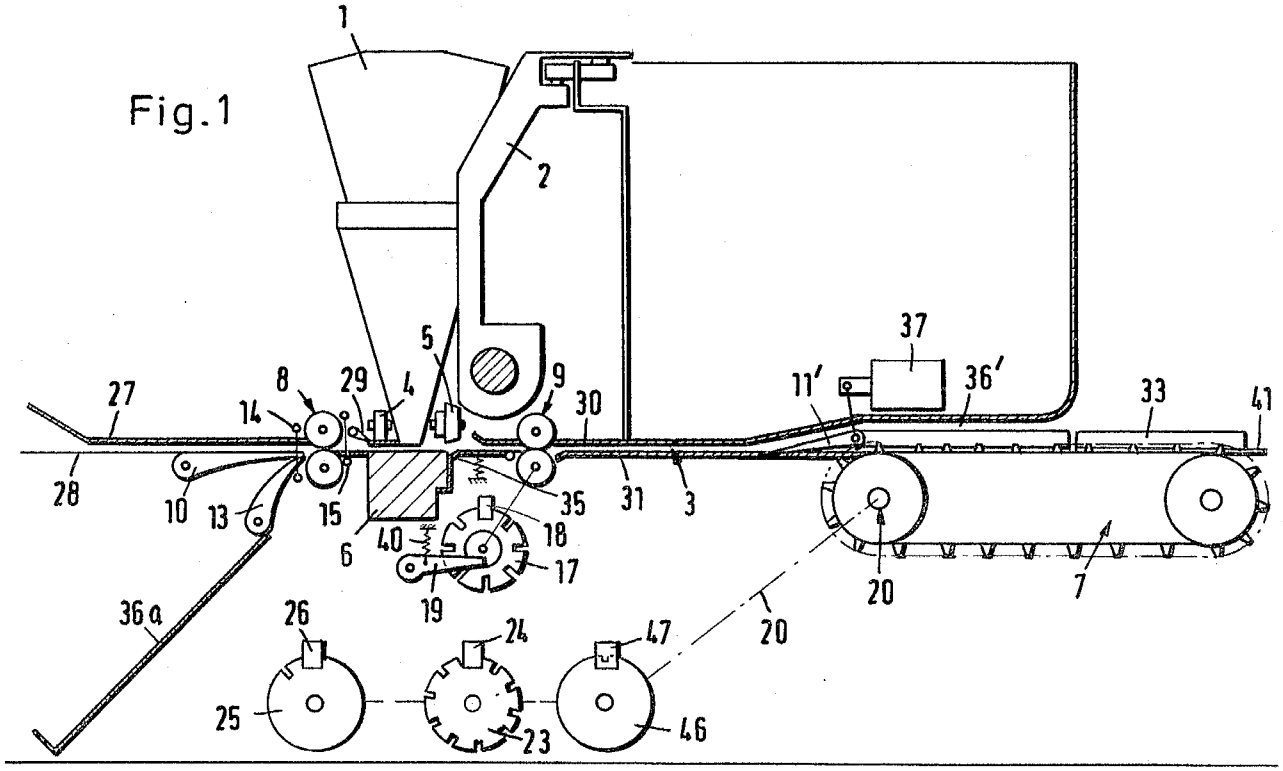
FIG. 1 is a schematic side and section view of relevant parts of the ticket printer in accordance with an embodiment of the invention, under omission of casing or housing parts.

The apparatus shown in FIG. 1 is very similar to the one shown in FIG. 2. The basic difference is the arrangement of the sprocket drive 7. This drive offers here a transport plane that is aligned with the print plane while the branch track 36 is arranged parallelly thereto and at a slight elevation. The switch 11 is shown here to be operated by an electromagnet 37, and the twin disks 21 of FIG. 2 are replaced by another control disk 46 cooperating with a sensor 47. The disk 46 has a single slot and pick up 47 operates the electromagnet 37. Thus, the mechanical linkage of switch operation of FIG. 2 is replaced here by an electrical control link. Reference numeral 41 denotes the sheet that has entered the device on and through sprocket drive 7. While the operational sequence is explained with reference to the structure of FIG. 2, the modification in the operation of the device shown in FIG. 1 will be immediately apparent on account of inherent similarities.

Figure 10:
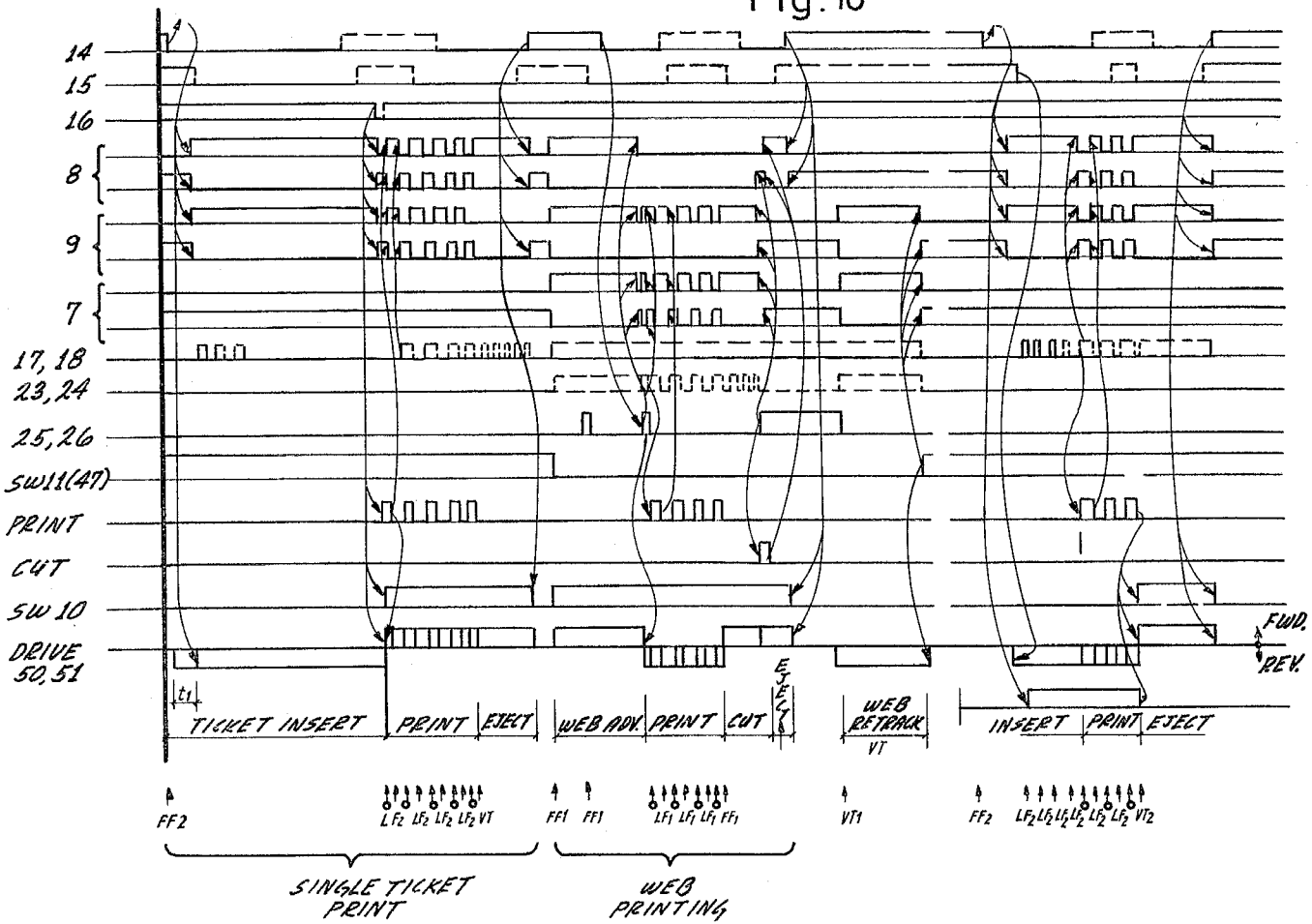
FIG. 10 is a pulse diagram for showing this control operation as it reflects in signal sequences.

FIG. 10 illustrates a signal diagram, particularly of the several relevant control signals and the resulting operation. Two lines each are marked 8,9 and 7; the upper line in each instance denotes clutch energization the lower line brake energization of the particular device 52, 53 and 54. In most instances these energization are logical opposites, but in several periods neither is energized indicating permissible idling of the drives 8 or 9.

The lines "print" merely identify printing of one line. Such a period begins when the clock (17,18 or 23, 24) signals a print position and ends by command of the print electronics which issues a "go" command (F1, or F2) for the drive control 60. The cut control is effective on the carriage only and begins with a signal from 26 and its end controls drive 8. The line marked "drive" denotes the direction of movement on the output side of 51 as applied to the several devices (if connected by the respective clutch). It should be noted that signals which are produced but are ignored in particular phases of the operation are drawn in dash dot lines. As far as the light barriers is concerned, a signal is high when the barrier is not interrupted.

FIG. 10 illustrates four operations. The first one occurs upon insertion of a single, precut ticket; the second one is a complete sequence of entry of and printing on the web followed by cutting and ejection. FF2 and FF1 are external commands for the controller for precut ticket or web printing. In the case of several web printings, the operation starts on the second FF1 only. The third sequence, beginning with an external command VTI, pulls the web away from a position of abutment of its leading edge with the platen cutting edge, until clearing switch 11, to prepare the printer for precut ticket printing. The fourth sequence represents a paper web advance operation under control of light barrier 15.

Figure 4:
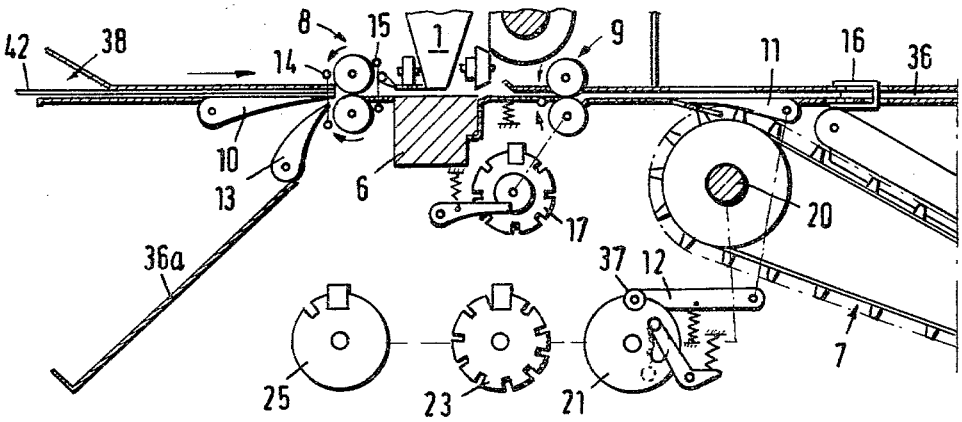
FIGS. 4, 5 and 6 are views similar to FIGS. 1 and 2 showing the operational sequence for precut ticket printing.
Figure 5:
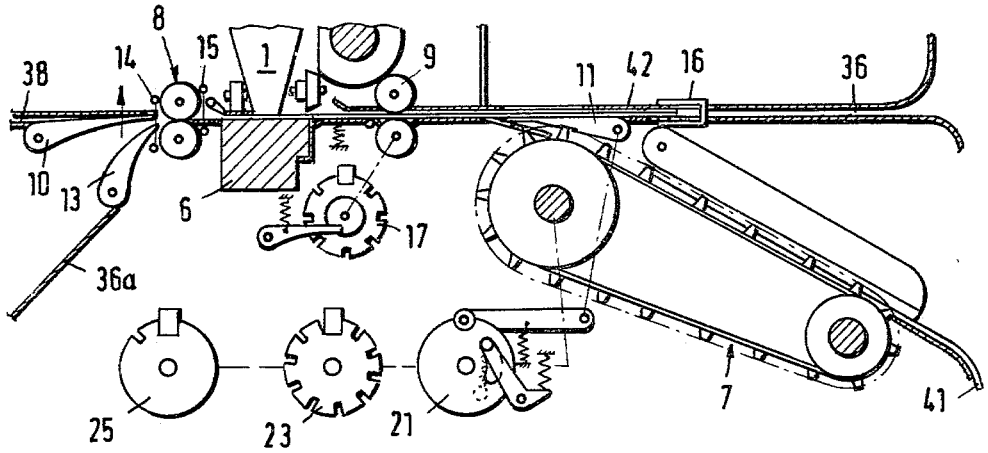
Figure 6:
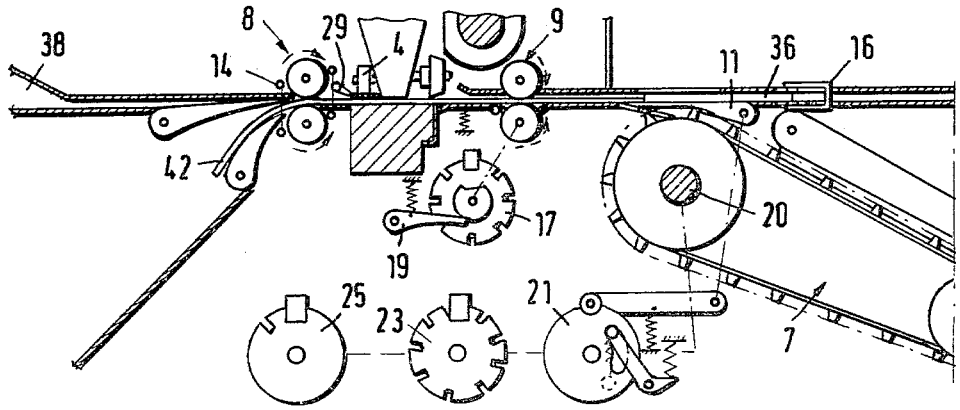

FIGS. 4, 5 and 6 illustrate the sequence when a precut, prepared form such as a ticket 42 is inserted in entrance mouth funnel, i.e. receiver slot or the like, 38 (1st case of FIG. 10). The operator forces the ticket into the receiver 38 and between the spring loaded rolls 8. Just prior thereto, light barrier 14 is interrupted (14 down) and that turns on the machine (inherent delay $t_1$). Also, all clutches are engaged. The motor (i.e. transmission 51) was switched to one particular direction on FFI. This direction is identified by a negative signal in FIG. 10 and one may conveniently term this the "reverse" direction. "Positive" is, therefore, associated with the opposite or "forward" direction, consistent with "upstream" and "downstream" introduced above.

Rolls 8 and 9 start to move in a direction to pull the ticket 42 back until reaching barrier 16 (FIG. 5; line 3 of FIG. 10) which signals stopping of the drives. This position of the ticket places the lowest print line (i.e. a potential print line close to one end of the ticket) in the reach of head 1 which may start printing at that point. Switch 10 will change position at about the time of the first printing; also the drive direction of 51 is reversed. After printing one line, rolls 8 and 9 drive the ticket e.g. by one line spacing as determined by clock 17,18, i.e. the latter control the common drive (or the drives in common) for the rolls 8 and 9 in a stepwise, stop and go fashion.

As far as the stop and go control of the drives during printing is concerned, the "go" command issues from the print electronics and is identified in the last line as F2. This signal pulls the brakes and sets the clutches. The stop command of course issues from the clock 17, 18 after the ticket has traversed a length equal to a line spacing. In the case of a line skip, a go command may follow immediately, or internal electronics may meter clock pulses 17,18 before permitting that a stop command be issued in the first place. The first step forward was commanded by the light barrier 16, the next steps are commanded by clock 17, 18. FIG. 6 shows also the printing in progress.

Upon completion of printing in accordance with the print program, the stop and go operation of the drives is overridden by a command VT from the print electronics resulting in a short continuous drive of rolls 8 only to eject the ticket onto tray 36*a*. That step is terminated by light up of light barrier 14 as the trailing edge of the ticket clears the barrier. That trailing edge signal pulls also in the brakes for 8 and 9 and stops the motor. It can readily be seen that sprocket drive 7 should remain stationary due to the linkage 39 and the position should be such that the switch 11 is held in the down position throughout this operation as consistently shown in FIGS. 4, 5 and 6, but also in FIG. 2 (see also line SW. 11 in FIG. 10).

Figure 7:
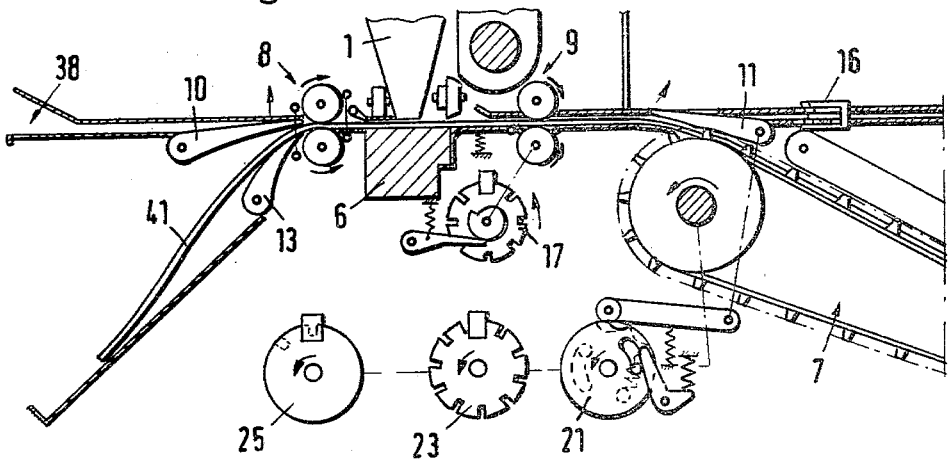
FIGS. 7, 8 and 9 are views showing analogously the operational sequence for printing on a roll of strip or web.
Figure 8:
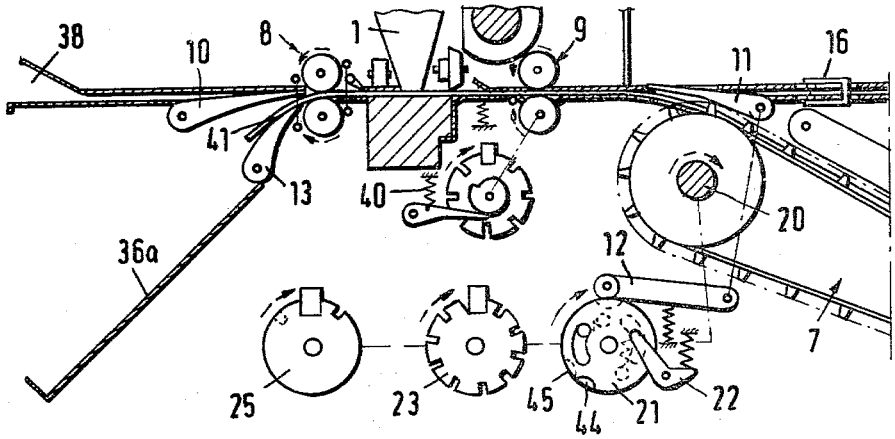
Figure 9:
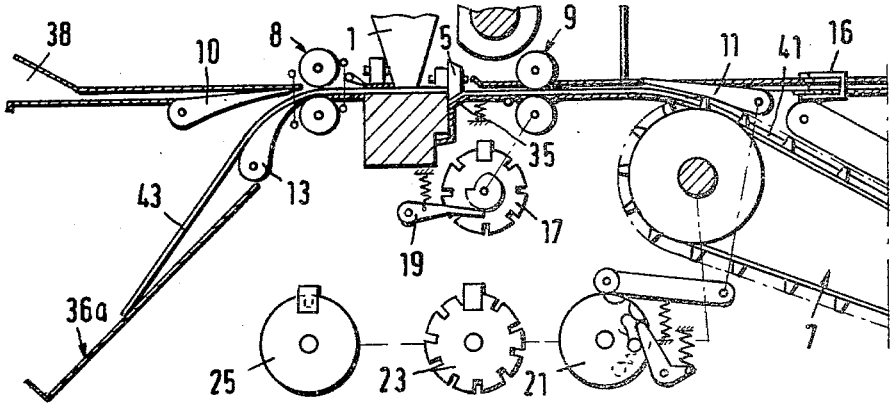

FIGS. 7, 8 and 9 illustrate an operational sequence for printing on a web or endless sheet. All drives participate in that operation. It should be noted that the belt of the sprocket drive should have a particular marking to indicate placement of the leading edge of a web (being for example a multi-layer web assembly) which leading edge may be one end of the first preprinted form thereon. That marking has a particular orientation relation to the slot of disk 25 such that the leading edge of the web will e.g. align with the cutter plane (i.e. the rear edge of platen 6) when the slot in disk 25 is aligned with the pick up 26.

The operation begins with an external FFI command turning the motor on and releasing all the brakes. The sheet or web 41 is moved by the sprocket drive 7 (e.g. through manual turn on initially) and soon roll drive 9 grips the leading end of the web and moves it between the plate and the print head. The twin disk 21 actuates lever 12 so that switch 11 is pushed up (or magnet 37 lifts the switch as per FIG. 1).

The operation of the twin disks is such that the first (visible) one with the slot is moved and carries along the rear one (behind the plane of the drawing) after the pin has been retracted by the spring whereupon the arcuate slots misalign. The disks 21 can now turn, even more than 360° counterclockwise, and lever 12 will not change position.

As the front or leading edge of the web passes the cutting plane, a pulse 25, 26 is produced, which, however, is ignored. As far as the control is concerned, this state is defined in that the light barrier 14 is still not interrupted when the form clock pulse 25,26 is produced. It was found practical to continue the sheet advance until a complete ticket length has passed the cutting plane. This occurs when following darkening of light barrier 14 (signal 14 down) pick up 26 produces a pulse. The position of disk 25 is well defined with the edge of the web 41 as held in readiness by the sprocket 7. That pulse deenergizes also the clutch for drive 8 without energizing the brake. The same is true for drive 9 but not for drive 7. Also, the direction of drive output (50, 51) is reversed, and the drives 8 and 9, under control of clock 23,24 until the first print line position is under print head 1. Rollers 8 should not be driven for this operation nor are they braked, as that is better for holding the sheet taught in the print zone. Drive 9 participates in the stepwise movement, but not its brakes. Only sprocket drive 7 is braked for printing. Thereafter, printing progresses as before in stop and go fashion by clock 23,24 and by the electronic print control signals F1 but in the reverse direction, i.e. the web is pulled back, to the right and not pushed through the printing zone.

After completion of printing and on external command FFI the motor reverses to forward and drives 7 and 9 move the web to cutting position and the carriage operates as cutter (FIG. 9). Cutting position is attained when the clock 25, 26 issues a pulse, because, as stated above, the system is adjusted that a border between two tickets or the end of a ticket on web 2 is reached when the disk 25 so signals via pick up 26. The same signal stops the drives and pulls the brakes and triggers the cutter operation on the carriage (FIG. 9). End of cutting releases the brake of 8 and pulls in the clutch. All other drives remain braked. Drive 8 advances the now cut ticket 43 until being ejected. As the trailing edge of the cut ticket passes light barrier 14 (signal up), drive 8 is stopped and braked and the motor is stopped. Switch 10 is pulled down, but switch 11 remains up.

It can thus be seen that precut tickets and tickets to be cut from a long web are being printed on in different directions. There are two reasons for this difference. Precut tickets usually have a bar code on one end which must be read by a pick up on the carriage. This pick up is not shown because it does not concern the ticket drive. Bar code reading is inherently the first operation, prior to printing so that printing should begin on that end, which really is the bottom of the ticket. Reading is necessary because different preprinted tickets may be used for different print operations and the correct one must be inserted in each instance. The bar code identifies the type of pre-printed ticket accordingly.

In the case of web printing, it was found that the stop and go operation of the printing should not be carried out via a direction amounting to a pushing advance of the leading edge, as bunching may occur, particularly if multi-layer printing is carried out. Thus, it was found in practice to be considerably less troublesome to advance the sheet in direction of its leading edge only initially and on ejection, but not during printing.

It can be seen that following printing on web, the leading edge of the remaining web is aligned with the plate cutting edge. The device 25, 26 signal is up so that upon passing FFI once nothing will happen, until FFI is commanded again whereupon the web will be advanced by one ticket length (one full revolution of 25) and pulled back in steps for printing.

After any on-the-web-printing, the web must be retracted if the next printing involves a ticket entered in funnel slot 38. An external signal VT may so command (third sequence in FIG. 10) whereupon drives 8 and 9 pull the step or web back. It should be noted that all through this time disks 21 remained disaligned. Now, the web is moved from a position of the equipment shown in FIG. 9. Only after a clockwise revolution, and after the latch 22 places itself behind the pin, the arcuate slots will realign and feeler 37 of arm 12 will drop to pull the switch 11 down. Not shown is a switch that monitors the disposition of switch 11, which will be pulled back when the two recesses of twin disk 21 realign. Thereupon retraction of the web is stopped by turning the motor off and energizing all the brakes.

Turning briefly to FIG. 1, the figure shows the state in which the switch 11 is drawn for opening the bypass 36' to receive a punched ticket, to be retrackted for printing. Sprocket drive 7 does not participate in this operation. The printing from the roll and on web 41 is preceded by a command FFI which can also be used to activate magnet 37 to pull the switch 11 up. That switch stays up until a command VTI to the controller signals rectraction of the web. The retraction, it will be recalled, starts from a position in which the slot in disk 25 is aligned with the pick up 20 (FIG. 9). If one compares the position of pickups and disks one can see that after not quite one complete revolution of disks 25 and 46, the slot of the latter is aligned with the pick up 47, i.e. the web is pulled back by not quite one form length which is sufficient for its leading edge to clear the switch 11. Pull back is stopped when pick up 47 signals "switch down". That some signal stops also the drives, sets the brakes and stops the motor.

The fourth sequence merely shows that the motor be turned on upon printing precut tickets sufficiently far to interrupt the light barrier 15. This may be an advisable alternative to make sure that upon such manual insertion the ticket is in fact engaged by the rollers 8.

The invention is not limited to the embodiments described above but all changes and modifications thereof not constituting departures from the spirit and scope of the invention are intended to be included.

We claim:

1. In a printer for printing individual forms on a web, including a print head and a platen, further including a cutter adjacent to the print head, the improvement of reversible web advance means disposed upstream from the platen and the print head for moving the web in a particular direction toward and through a space between the platen and the print head and in a direction opposite to said particular direction;

a friction drive disposed downstream from the platen and the print head so that the print head and the platen are located between the friction drive and the advance means;

first control means connected for operating the web advance means (a) for moving the web in said particular direction for the length of a form prior to printing and subsequent to previous printing, and (b) for stepwise retracting the web in the opposite direction during line-by-line printing;

the cutter being operated for cutting a form from the web following printing; and second control means for the friction drive for advancing the form as cut form in the particular direction, while the web remains stationary.

2. In a printer as in claim 1, said advance means including a sprocket drive and means for reversing the sprocket drive.

3. In a printer as in claim 1, said advance means being coupled to format clock means issuing a control pulse after the advance means has advanced the web for the length of a form.

4. In a printer as in claim 1, said advance means being coupled to a line clock means issuing clock pulses defining a print line spacing.

5. In a printer as in claim 4, the advance means including a sprocket drive engaging the web.

6. In a printer as in claim 5, said advance means further including at least one friction drive upstream from the print head.

7. In a printer as in claim 1, said friction drive cooperating with the advance means for moving the web in the particular direction prior said printing.

8. In a printer for printing individual forms such as tickets, using individual forms as well as a web from which forms are to be cut by a cutter in the printer, the printer further having a print head, a platen and a form and web feed and transport mechanism for moving the web or form in between the platen and the print head, the improvement comprising;

a first pair and a second pair of rollers disposed respectively to one side of the other of the platen;

sprocket means disposed upstream from the second pair of rollers, for moving a web towards the second and first pairs;

the cutter being disposed between the first and second pairs for cutting individual forms from the web;

control means for moving the sprocket means including advancing and retracting the web, including retracting the web from the cutter by a particular distance; and control means for selectively driving the pairs of rollers for moving a form or the web through a space between the print head and the platen.

9. In a printer as in claim 8, including clock means connected to the sprocket means for position control of the web following retraction.

10. In a printer as in claim 8, including clock means connected to at least one of the drive means and the sprocket means for stop and go control of form or web movement during printing.

11. In a printer as in claim 8 and including a light barrier downstream from the first pair for controlling movement of the first pair during ejection of an individual form or a form that has been cut by the cutter means.

12. In a printer for printing individual forms such as tickets, using individual forms as well as a web form which forms are to be cut by a cutter in the printer, the printer further having a print head, a platen and a form and web feed and transport mechanism for moving the web or form in between the platen and the print head, the improvement comprising:

a first pair and a second pair of rollers disposed respectively to one side and the other of the platen;

sprocket means disposed upstream from the second pair of rollers, for moving a web towards the second and first pairs;

a receiving tray disposed downstream of the first pair of rollers;

a bypass track disposed upstream from the second pair, bypassing the sprocket means for temporarily receiving a form;

a switch disposed between the second pair and the sprocket means for selectively connecting the sprocket means in line with the second and first pair of rollers for establishing a continuous web feeder path, and for alternatively connecting the bypass in line with the second pair for permitting a form in the bypass to be moved by the second pair between the platen and the print head; and reversible drive means for selectively driving the pairs and the sprocket means individually or in unison and in synchronism.

13. In a printer as in claim 12, a second switch disposed between the tray and the first pair of rollers; means defining an entrance for a form to be pushed through the entrance into engagement with the rollers of the first pair when the switch has position blocking passage to the tray.

14. In a printer as in claim 13, including a first light barrier downstream from the first roller pair and responding to insertion of an individual form through said entrance to control start up of the drive means, at least for the rollers of the first pair.

15. In a printer as in claim 12, said platen having a rear end cutting edge of the cutter facing the second drive rollers;

a resiliently yielding guide sheet between the edge and the second drive rollers, the cutter further including a cutting roller disposed for movement transverse to a direction of web movement as provided by said drive rollers.

16. In a printer as in claim 12 and including a further switch bypassing the tray for the ejection of misprints.

17. In a printer as in claim 12 including a light barrier downstream from the first rollers to control the drive means for ejection of a form.

18. In a printer as in claim 12, including a light barrier in the bypass track for controlling the distance of moving a form into the bypass track.

19. In a printer as in claim 12 and including clock means operatively coupled to at least one of the roller means and the sprocket means for stop and go control of the drive means during printing.

20. In a printer, for printing individual forms selectively on a web or precut forms, the printer including a print head and a platen, further including a cutter adjacent to the print head, the improvement comprising:

reversible web advance means for moving the web in a particular direction toward and through a gap between the platen and the print head and in a direction opposite to said particular direction, the web advance means being disposed upstream from the print head and the platen;

a bypass track also disposed upstream from the print head and the platen, by-passing the advance means;

a reversible friction drive disposed adjacent to said gap;

a switch disposed for selectively connecting the advance means or the bypass in line with the friction drive means and said gap between the platen and the print head;

first control means connected for operating the web advance means to feed a web in forward direction toward and through the gap, for reversing said movement and for reversing the movement again, to move the web in the forward direction, said switch having a disposition to connect the advance means in line with said gap;

the cutter cutting a form from the web following the reversal and forward movement of the web;

second control means connected for operating the friction means in said forward direction after the form has been cut from the web, or after a precut form has been moved into said bypass, further connected for operating the friction means in a reverse direction for moving the precut form into said bypass, said switch having a disposition accordingly.

21. In a printer as in claim 20, including a precut form receiver, an output tray, and second switch means, all downstream from the platen and the print head, the second switch means provided for selectively connecting the precut form receiver, or the output tray, in line with the feeder path.

* * * * *